US011607092B2

(12) United States Patent
Nethercott et al.

(10) Patent No.: US 11,607,092 B2
(45) Date of Patent: Mar. 21, 2023

(54) COLLAPSIBLE TOILET FOOTREST

(71) Applicant: Squatty Potty, LLC, St. George, UT (US)

(72) Inventors: Tony Nethercott, St. George, UT (US); Phillip Dietz, St. George, UT (US); Dennis Leavitt, St. George, UT (US)

(73) Assignee: SQUATTY POTTY USA, LLC, New York, NY (US)

( * ) Notice: Subject to any disclaimer, the term of this patent is extended or adjusted under 35 U.S.C. 154(b) by 0 days.

(21) Appl. No.: 16/539,917

(22) Filed: Aug. 13, 2019

(65) Prior Publication Data

US 2020/0046180 A1 Feb. 13, 2020

Related U.S. Application Data

(60) Provisional application No. 62/718,317, filed on Aug. 13, 2018.

(51) Int. Cl.
*A47K 17/02* (2006.01)

(52) U.S. Cl.
CPC ..... *A47K 17/028* (2013.01)

(58) Field of Classification Search
CPC .... A47K 17/028; A47C 16/02; A47C 16/025; A47C 12/00; A47C 4/04; A47C 4/045; A47C 4/08; A47C 4/10; A47C 4/18; A47C 4/20
See application file for complete search history.

(56) References Cited

U.S. PATENT DOCUMENTS

| | | | | |
|---|---|---|---|---|
| 4,437,413 | A * | 3/1984 | O'Brian | B25H 1/04 108/129 |
| 4,630,861 | A * | 12/1986 | Henschel | A47C 4/08 108/124 |
| 10,694,859 | B1 * | 6/2020 | Wickland | A47C 16/02 |
| 2013/0228103 | A1 | 9/2013 | Eveleth | |
| 2014/0131138 | A1 | 5/2014 | Simpson et al. | |
| 2015/0272410 | A1 * | 10/2015 | Lavassani | A47K 17/028 4/254 |
| 2015/0327739 | A1 | 11/2015 | Edwards et al. | |

FOREIGN PATENT DOCUMENTS

| | | | | |
|---|---|---|---|---|
| GB | 2440224 | A * | 1/2008 | A47C 12/00 |
| JP | 2018040204 | | 3/2018 | |

* cited by examiner

*Primary Examiner* — Erin Deery
(74) *Attorney, Agent, or Firm* — Gottlieb, Rackman & Reisman, PC

(57) ABSTRACT

A collapsible toilet footrest has a foot platform and two collapsible sidewalls, the sidewalls having one or more hinges. When not in use, the user may collapse the sidewalls, which are closed between the foot platform and a front face. When in use, the sidewalls may be locked or otherwise secured into position so as to create a stable, raised foot platform.

11 Claims, 10 Drawing Sheets

COLLAPSIBLE TOILET FOOTREST

CROSS-REFERENCE TO RELATED APPLICATIONS

This application claims the benefit of U.S. Provisional Application Ser. No. 62/718,317, filed on Aug. 13, 2018, which is incorporated herein by reference.

TECHNICAL FIELD

The present disclosure relates to toilet footrests. More specifically, the present disclosure relates to a collapsible footrest.

BACKGROUND

Humans can perform defecation in different postures: the two most common are squatting or sitting positions. The squatting posture is usually used when using a squat toilet (mainly a feature of the developing world), or when toilets are unavailable. The sitting posture during defecation is a standard posture seen in the western world because western-style toilets usually require a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased, which allows the puborectalis muscle to fully relax, which aids defecation by reducing the amount of effort needed to empty the bowels.

The advantages of the squatting position may be obtained when using western-style toilets (i.e., where the bowl is raised from the ground and is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, current stools in the art are often bulky and cannot be easily stored or transported. In an attempt to solve these problems, several foldable stools exist in the art. However, these stools have structural limitations and weaknesses due to their configuration. They also fail to fold to a sufficiently low profile. Therefore, there is a need for a stool that can be collapsed for easy storage and transport. The present invention seeks to solve these and other problems.

SUMMARY OF EXAMPLE EMBODIMENTS

The present disclosure is directed to a collapsible toilet footrest. In one embodiment, a collapsible toilet footrest comprises a foot platform and two collapsible sidewalls, the sidewalls each comprising one or more hinges. When not in use, the user may collapse the sidewalls, which are enclosed within the foot platform and front face. When in use, the sidewalls may be locked or otherwise secured into position so as to create a stable foot platform.

DETAILED DESCRIPTION OF EXAMPLE EMBODIMENTS

Figure 1:
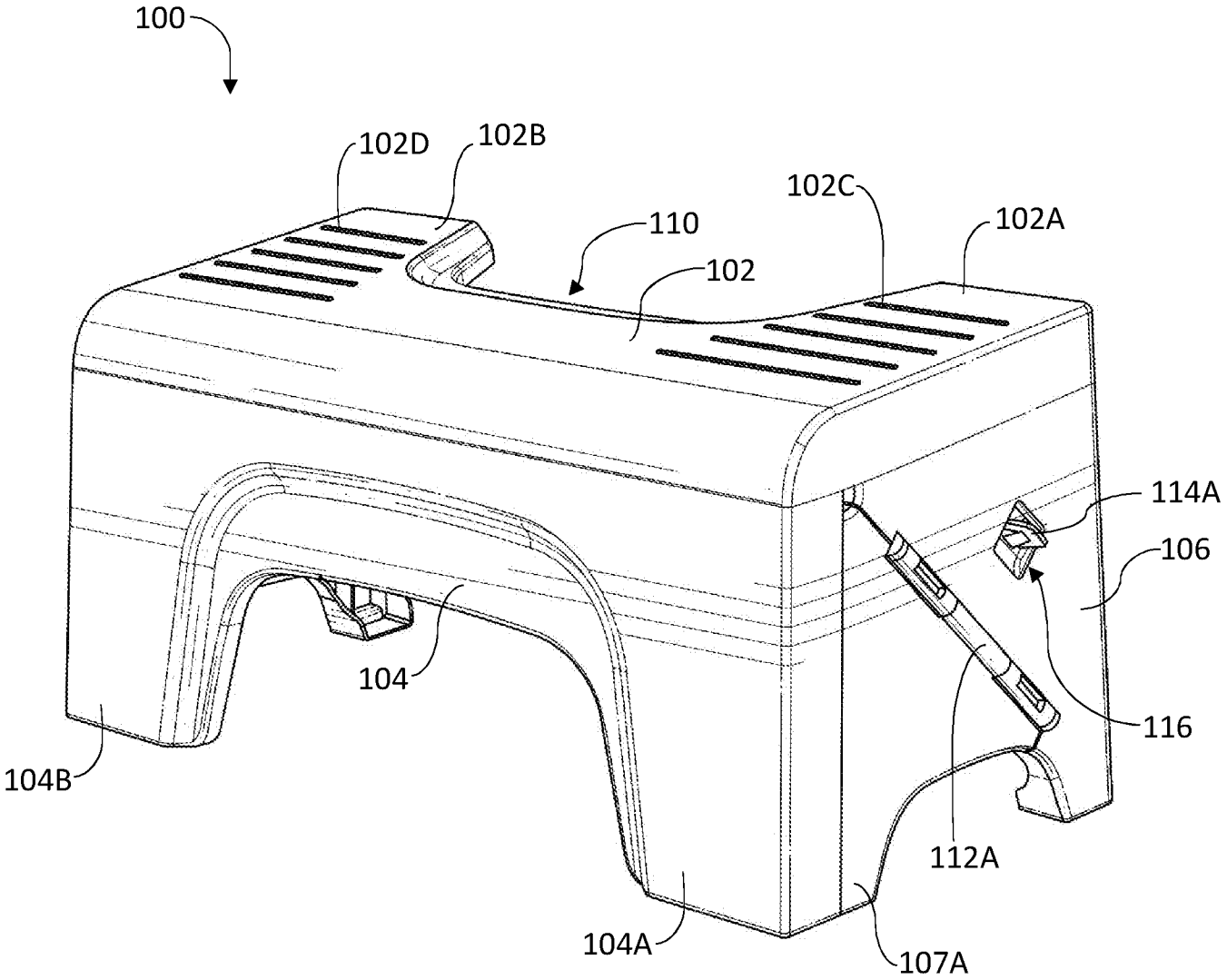
FIG. 1 is a front, left side perspective view of a collapsible toilet footrest in a deployed position.
Figure 2:
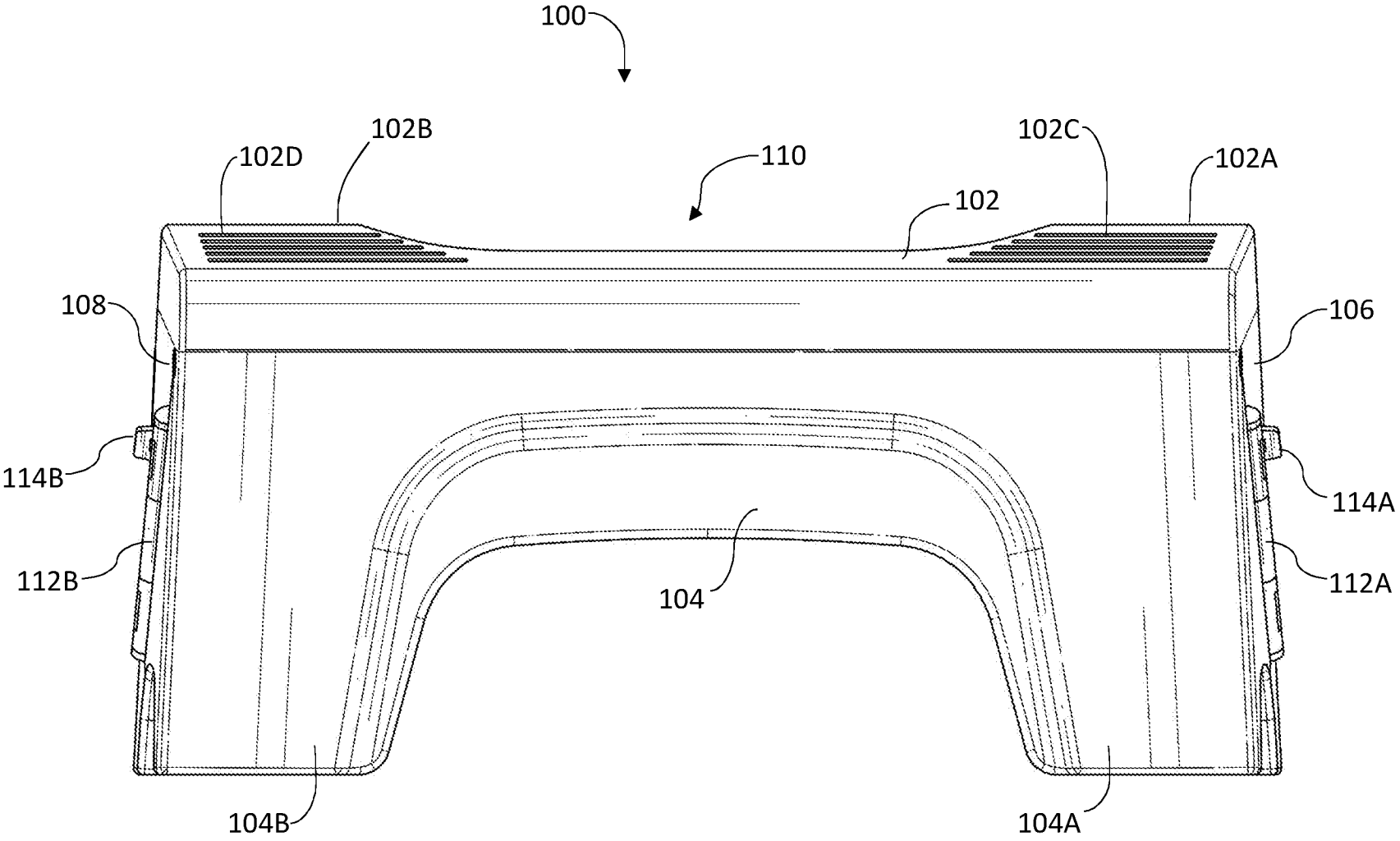
FIG. 2 is a front elevation view of a collapsible toilet footrest in a deployed position.
Figure 3:
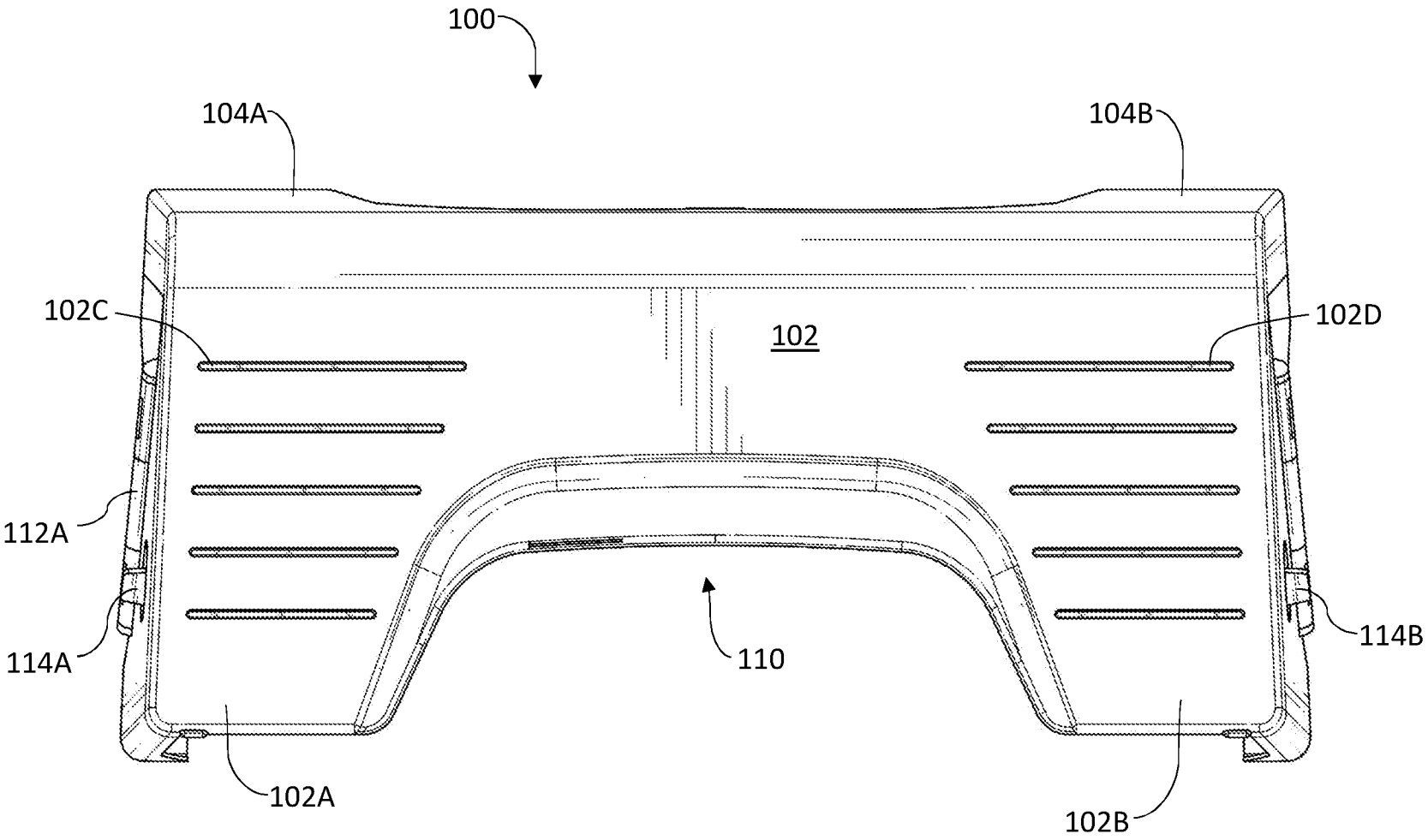
FIG. 3 is a top plan view of a collapsible toilet footrest in a deployed position.
Figure 4:
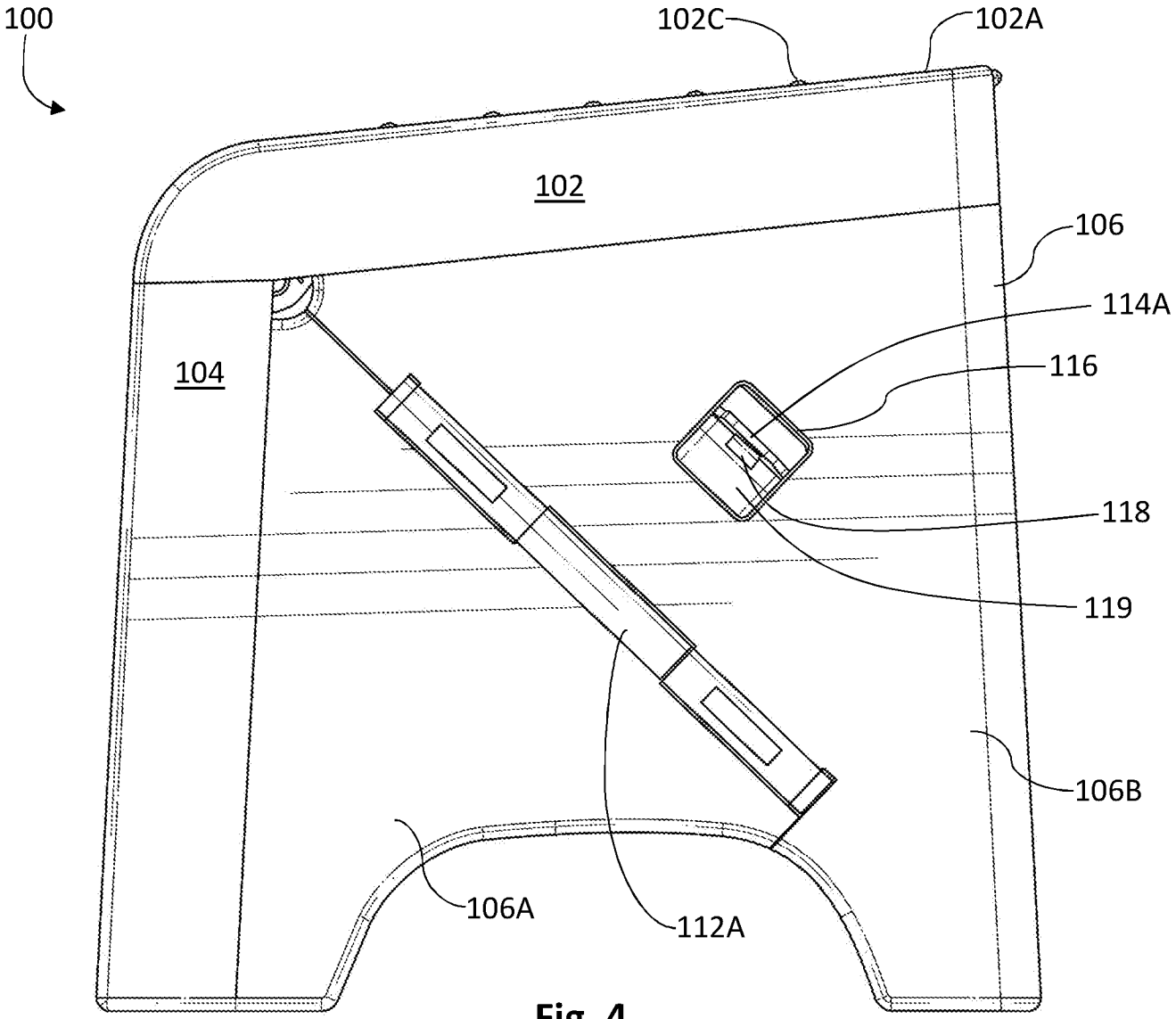
FIG. 4 is left side elevation view of a collapsible toilet footrest in a deployed position.

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrases "in one embodiment" or "in an embodiment" do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical or electrical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

The present disclosure is directed to a collapsible toilet footrest. In one embodiment, as shown in FIGS. 1-4, the collapsible toilet footrest 100 comprises a foot platform 102, a front face 104, left sidewall 106, and right sidewall 108. The foot platform 102 comprises a cutout 110 for receiving the base of a toilet. The cutout 110 may be rounded, rectangular, oval, or any number of shapes. The cutout 110 allows the collapsible toilet footrest 100 to easily slide proximal to the base of a toilet, with a first side 102A on a first side of the toilet base and a second side 102B on an opposite side of the toilet base. Each side 102A, 102B may further comprise anti-slip surface 102C, 102D, respectively. The anti-slip surfaces 102C, 102D may be grooves, ribs, textures, etc. Front face 104 comprises a first side 104A and a second side 104B. Each side 104A, 104B functions as a front support leg, supporting foot platform 102. While front face 104 is illustrated as having two sides 104A, 104B, it may also be one continuous wall without a cutout therebetween.

Each sidewall 106, 108 is collapsible using one or more hinges 112A, 112B. For example, referring to FIGS. 4-6, sidewall 106 is divided into front portion 106A and rear portion 106B with a sidewall hinge 112A hingedly coupling the first portion 106A to the rear portion 106B. As the hinge moves inward, the first portion 106A and second portion 106B abut one another, with the foot platform 102 and the front face 104 likewise abutting one another (best shown in FIGS. 8-9). To prevent the sidewall hinge 112A from actuating accidentally and thereby collapsing the sidewall 106, a locking tab 114A is actuatable and may be used to selectively lock or unlock the sidewall hinge 112A. For example, the locking tab 114A may extend from front portion 106A and may protrude through lock opening 116 in rear portion 106B. The locking tab 114A comprises a tongue 118 that engages the locking surface 119 of rear portion 106B. With the locking tab 114A engaged, the sidewall hinge 112A is incapable of actuating. To unlock, a user exerts an upward force on the locking tab 114A (away from sidewall hinge 112A), thereby disengaging the tongue 118 from the locking surface 119 of rear portion 106B and allowing the locking tab 114A to pass inwardly through lock opening 116. With the locking tab disengaged, the sidewall hinge 112A is allowed to bend inwardly, thereby collapsing the sidewall 106.

While a locking tab 114A, 114B having a tongue 118 is shown, other locking mechanisms may be used. For example, the locking tab may have a slidable bar that slides into, and out of, the sidewall hinge 112A. When the slidable bar is positioned in the sidewall hinge 112A, the hinge is prevented from actuating. When the locking tab is actuated in a direction opposite the hinge, thereby withdrawing the slidable bar from within the sidewall hinge 112A, the hinge is capable of actuating, thereby collapsing the sidewall 106. Other hinge-lock mechanisms may likewise be used without departing herefrom. As shown, the sidewall hinge 112A is positioned at an angle of less than ninety degrees to the foot platform (e.g., forty-five degrees), which allows the sidewalls 106, 108 to collapse inwardly while remaining coupled to both the front face 104 and foot platform 102.

Further, each front portion 106A, 108A comprises a front leg 107A, 109A, respectively. In addition, each rear portion 106B, 108B comprises a rear leg 107B, 109B, respectively. Accordingly, when in the deployed position, as shown in FIG. 8, each leg 107A-B, 109A-B supports the foot platform 102.

Figure 5:
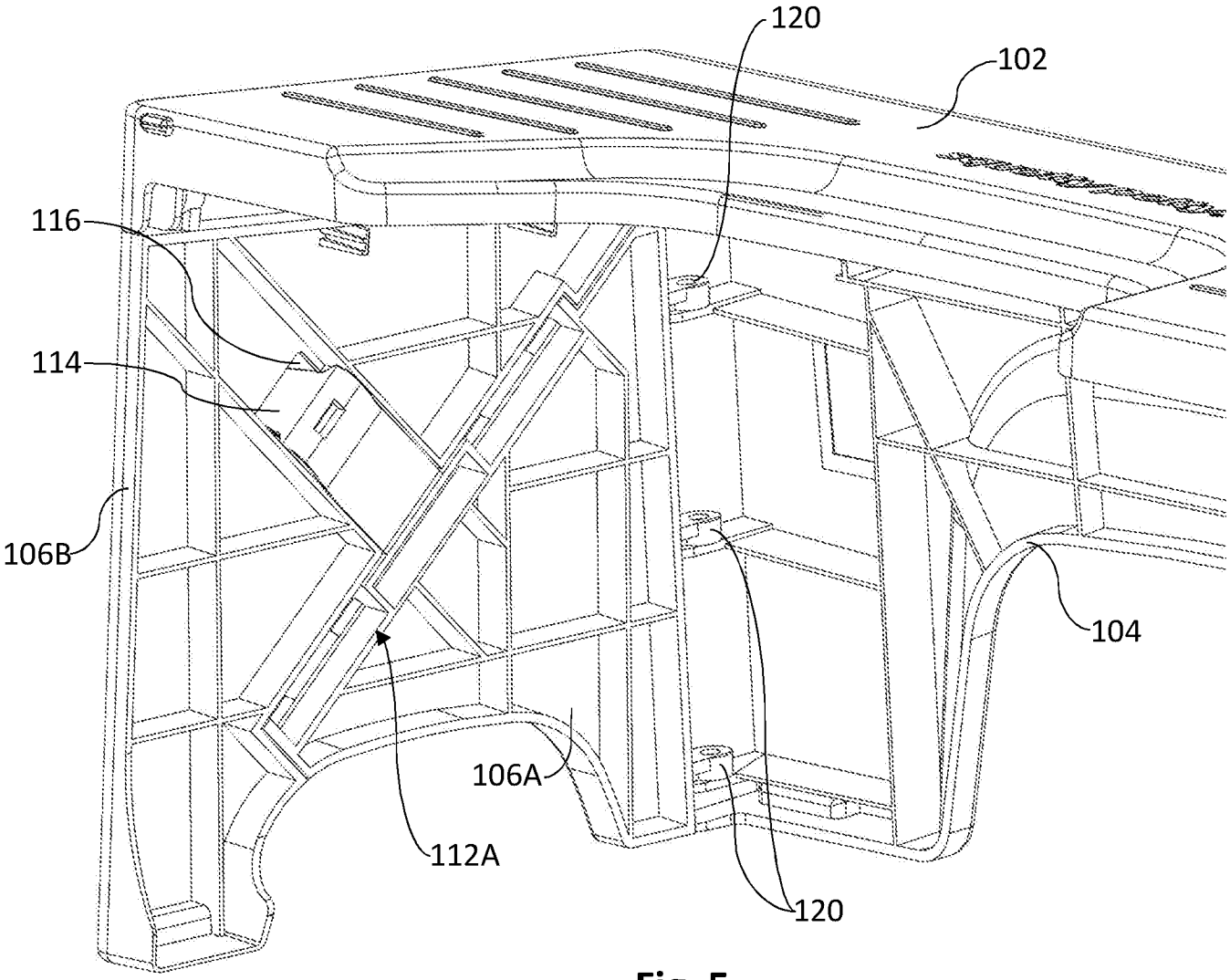
FIG. 5 a left, rear detailed view of a collapsible toilet footrest in a deployed position.
Figure 6:
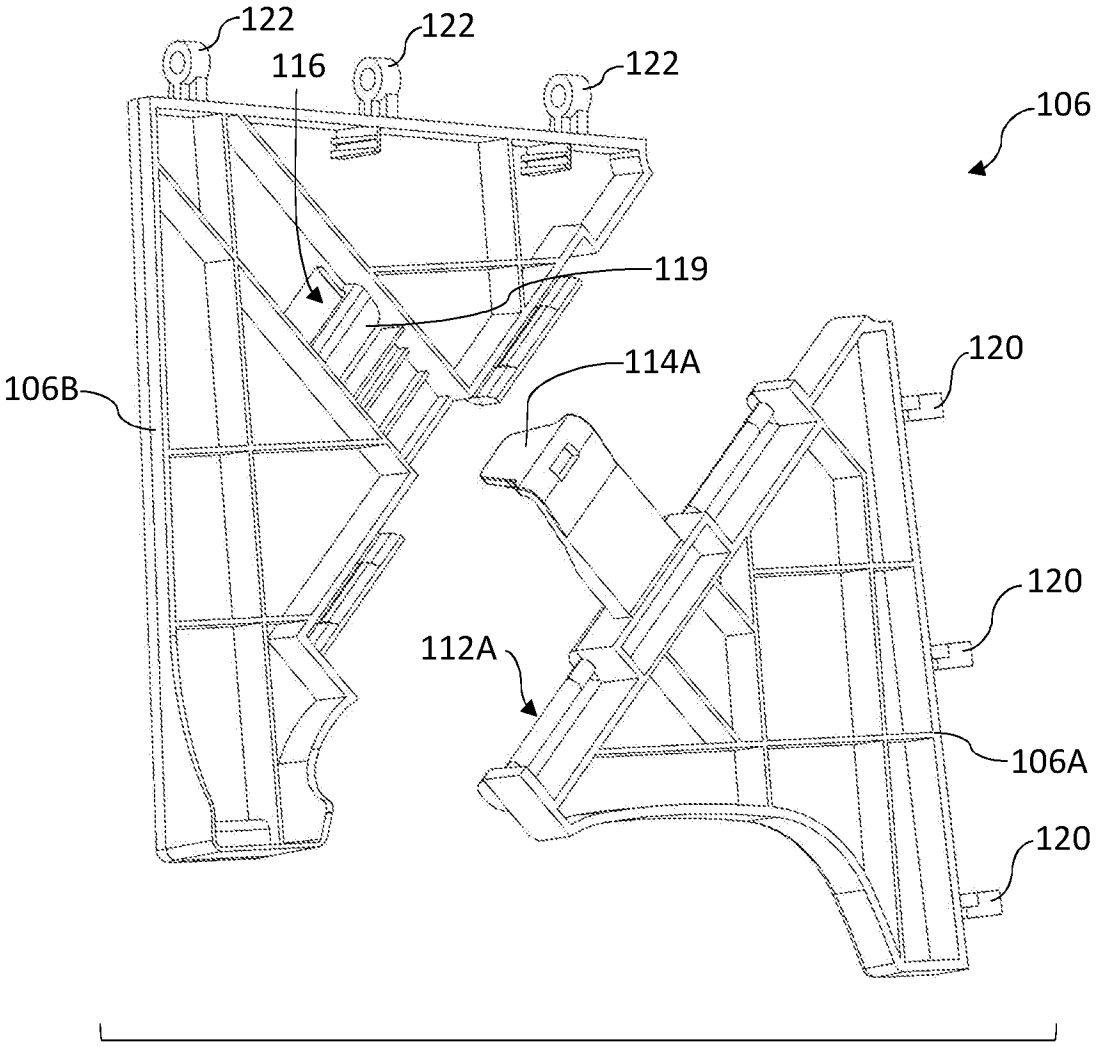
FIG. 6 is an exploded view of a sidewall assembly of a collapsible toilet footrest.
Figure 7:
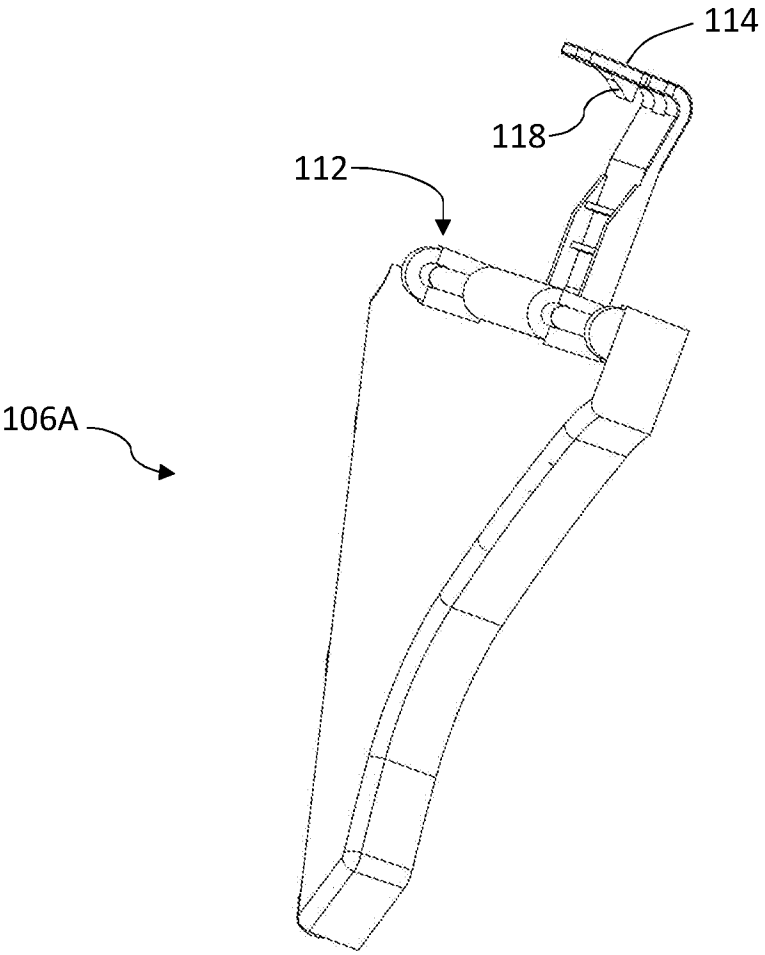
FIG. 7 is a side perspective view of a front portion of a sidewall assembly of a collapsible toilet footrest.

As best seen in FIGS. 5-7, as the sidewall hinge 112A actuates, the front portion 106A pivots in relation to the front face 104, using hinges or other rotators 120. Likewise, rear portion 106B pivots in relation to the foot platform 102 using rotators 122. Rotators 120, 122 may be circular components having an eyelet for receiving a pin or similar component from the foot platform 102 and front face 104, allowing the rotators 120, 122 to pivot while remaining coupled to the front face 104 and foot platform 102, respectively. However, other pivoting mechanisms may be used without departing herefrom.

Figure 8:
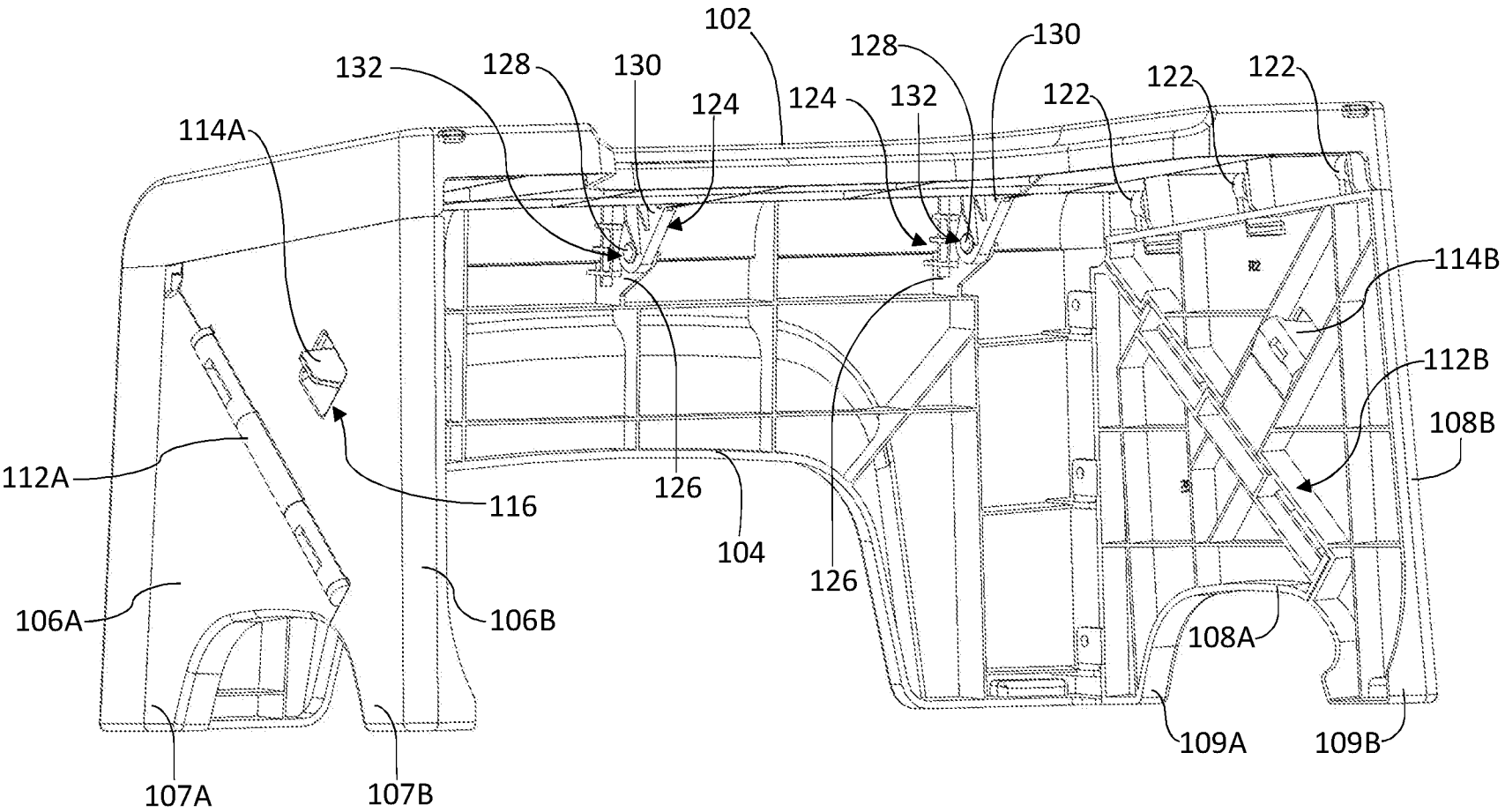
FIG. 8 is a rear perspective view of a collapsible toilet footrest in a deployed position.

Referring to FIG. 8, the foot platform 102 and front face 104 are pivotably coupled to one another using rotators 124. For example, the front face 104 may have front tab 126 with a cylindrical protrusion 128 thereon, while foot platform 102 may have platform tab 130 with an aperture 132 thereon for receiving the cylindrical protrusion 128 of the front tab 126 of the front face 104. The cylindrical protrusion 128 is rotatable within the aperture 132 of the platform tab 130 of the foot platform 102, allowing a pivotable relationship between the foot platform 102 and front face 104. Accordingly, when a user desires to collapse the collapsible toilet footrest 100, the user ensures that the locking tabs 114A, 114B are disengaged, pushes the hinges 112A, 112B inward, and then forces the foot platform 102 and front face 104 inward, enclosing the sidewalls 106, 108 between the foot platform 102 and the front face 104, as best shown in FIGS. 9-10.

Figure 9:
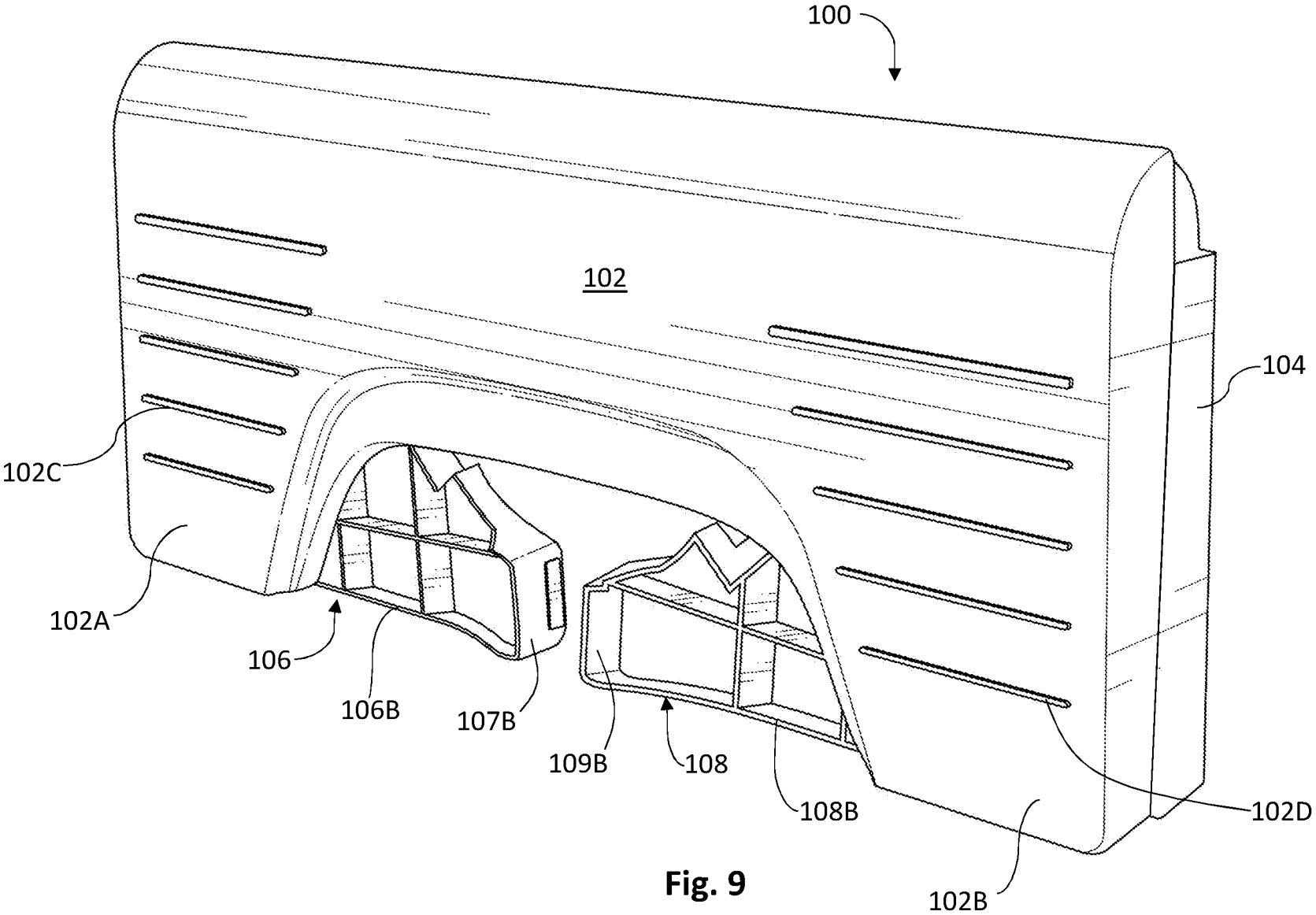
FIG. 9 is a top perspective view of a collapsible toilet footrest in a collapsed position.
Figure 10:
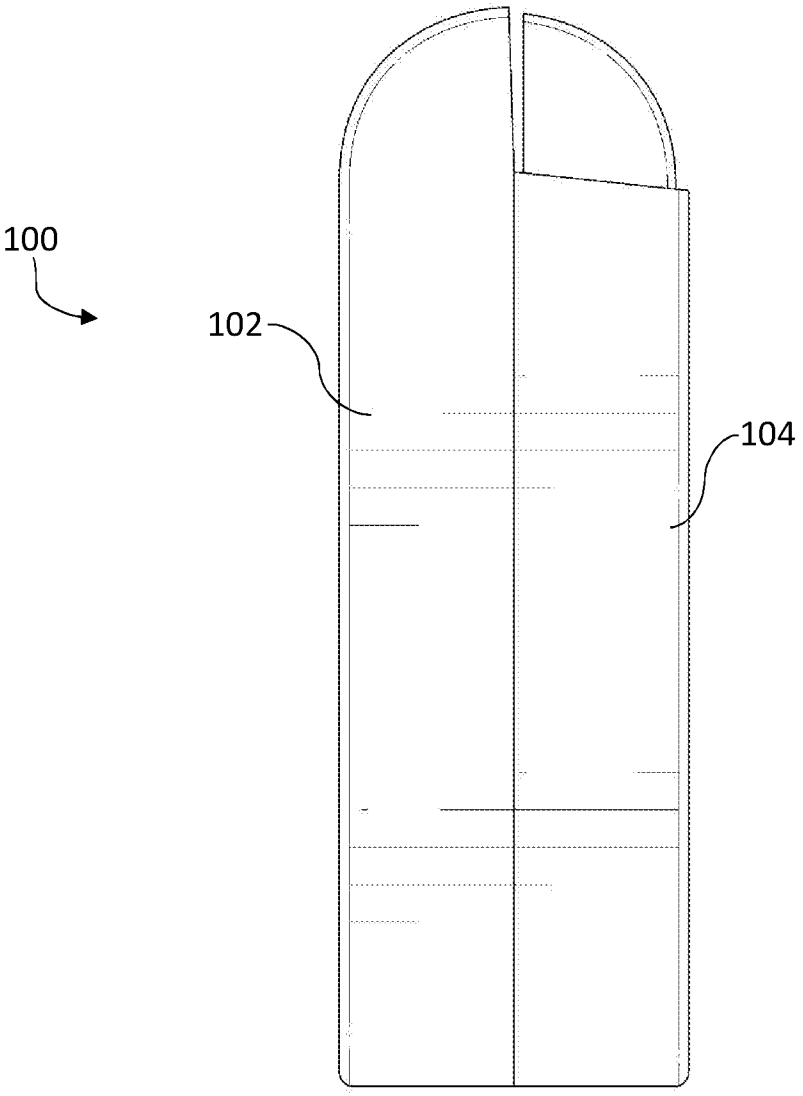
FIG. 10 is a side elevation view of a collapsible toilet footrest in a collapsed position.

Referring to FIGS. 9-10, the collapsible toilet footrest 100 is shown collapsed. As shown in FIG. 9, the rear portion 106B, 108B abuts the foot platform 102, the front face enclosing the sidewalls 106, 108 therebetween. When viewed from the side, as shown in FIG. 10, foot platform 102 and the front face 104 completely enclose the sidewalls 106, 108 therebetween. This allows the collapsible toilet footrest 100 to be easily stored and/or transported. While stools with hinges exist in the art, the hinges are exposed and typically actuate outwardly, as opposed to inwardly as disclosed herein. However, the change from outward actuating hinges to inward is significant: because the hinges 112A, 112B are enclosed, the risk of injury to a user's hands is lowered. In addition, the hinges 112A, 112B last longer and perform better as a result of being protected from exposure (e.g., keeping the hinge from getting gummed up). However, when changing the hinge from outward actuating to inward actuating, the need for a locking mechanism is required. As a result, the hinges 112A, 112B disclosed herein with the locking tab 114A, 114B overcome problems in the art.

Therefore, in one method of use, a user would deploy the collapsible toilet footrest 100 by pulling the front face 104 away from the foot platform 102, which actuates the hinges 112A, 112B and extends the sidewalls 106, 108. The user would ensure that the hinges 112A, 112B are locked by ensuring that the locking tab 114A, 114B has passed through lock opening 116 and that the tongue 118 engages the locking surface 119. With the collapsible toilet footrest 100 in the deployed position, a user may place the cutout 110 at the base of a toilet. While using the toilet, the user may rest their feet on the foot platform 102, putting them in the correct position for elimination. Once complete, the user may slide the toilet footrest 100 further under the toilet, placing the cutout 110 against the base of the toilet until its next use. If a user desires to store or transport the footrest 100, the user would disengage the locking tab 114A, 114B, push the hinges 112A, 112B inward to begin collapsing the sidewalls 106, 108, then force the foot platform 102 and the front face 104 together, closing the hinges 112A, 112B therebetween. In one embodiment, a securing mechanism may keep the collapsible toilet footrest 100 in the collapsed position. For example, a strap, a tongue and groove, magnets, or other components may be used to keep the foot platform 102 abutting the front face 104. As appreciated, because the collapsible toilet footrest 100 is collapsible, it allows a user to easily store and travel with the footrest 100, providing the user with the ability to properly eliminate regardless of location.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A collapsible toilet footrest, comprising:

a one-piece foot platform having a cutout configured to extend about and abut a base of a toilet;

a front face hingedly coupled to the foot platform; and a first sidewall and a second sidewall, wherein each of the first sidewall and the second sidewall comprises:

a front portion hingedly coupled to the front face, the front portion comprising a front leg;

a rear portion hingedly coupled directly to the foot platform, the rear portion comprising a rear leg;

a sidewall hinge coupling the front portion and the rear portion to each other; and a locking tab extending from one of the first sidewall and the second sidewall that is configured to selectively lock the sidewall hinge in a fixed, open configuration.

2. The collapsible toilet footrest of claim 1, wherein the first sidewall and the second sidewall are interposed between an entirety of the foot platform and the front face when the footrest is in a collapsed configuration.

3. The collapsible toilet footrest of claim 1, further comprising an opening extending through one of the front portion and the rear portion with the locking tab, which extends from the other of the front portion and the rear portion selectively receivable through the opening.

4. The collapsible toilet footrest of claim 3, wherein the locking tab comprises a tongue for engaging a surface of the one of the front portion and the rear portion.

5. The collapsible toilet footrest of claim 1, wherein the front face comprises at least one front leg.

6. The collapsible toilet footrest of claim 1, wherein the front face has an external surface and an internal surface, the foot platform has an external surface and an internal surface and the front face and the foot platform are hingedly connected to each other at the internal surface of the front face and the internal surface of the foot platform with the external surface of the front face and the external surface of the foot platform devoid of any visible aspect of a connection in the open configuration.

7. The collapsible toilet footrest of claim 1, wherein the front portion of each of the first sidewall and the second sidewall has an external surface and an internal surface, the front face has an external surface and an internal surface and the front portion and the front face are hingedly connected to each other at the internal surface of the front portion and the internal surface of the front face with the external surface of the front portion and the external surface of the front face devoid of any visible aspect of a connection in the open configuration.

8. The collapsible toilet footrest of claim 1, wherein the front portion of each of the first sidewall and the second sidewall is at most hingedly connected to the front face and the rear portion.

9. The collapsible toilet footrest of claim 1, wherein the rear portion of each of the first sidewall and the second sidewall is at most hingedly connected to the foot platform and the front portion.

10. The collapsible toilet footrest of claim 1, wherein, in a collapsed configuration, the locking tab is disengaged and arranged between the front face and the foot platform.

11. The collapsible toilet footrest of claim 3, wherein, in the open configuration, the locking tab extends through the opening toward an external surface of the one of the front portion and the rear portion.

* * * * *